US009073728B2

(12) United States Patent
Shinada

(10) Patent No.: US 9,073,728 B2
(45) Date of Patent: Jul. 7, 2015

(54) AUTOMATIC WINDING DEVICE FOR FILAMENTOUS MATERIAL AND AUTOMATIC WINDING METHOD

(75) Inventor: Katsuhiko Shinada, Aichi (JP)

(73) Assignee: MITSUBISHI RAYON CO., LTD., Tokyo (JP)

( * ) Notice: Subject to any disclaimer, the term of this patent is extended or adjusted under 35 U.S.C. 154(b) by 0 days.

(21) Appl. No.: 14/114,222

(22) PCT Filed: Apr. 25, 2012

(86) PCT No.: PCT/JP2012/061095

§ 371 (c)(1),
(2), (4) Date: Oct. 28, 2013

(87) PCT Pub. No.: WO2012/147797

PCT Pub. Date: Nov. 1, 2012

(65) Prior Publication Data

US 2014/0048641 A1 Feb. 20, 2014

(30) Foreign Application Priority Data

Apr. 28, 2011 (JP) ..... 2011-102023

(51) Int. Cl.

| | |
|---|---|
| ***B65H 67/052*** | (2006.01) |
| ***B65H 67/056*** | (2006.01) |
| ***B65H 54/20*** | (2006.01) |
| ***B65H 67/044*** | (2006.01) |

(52) U.S. Cl.

CPC ..... *B65H 67/044* (2013.01); *B65H 54/205* (2013.01); *B65H 67/052* (2013.01); *B65H 67/056* (2013.01); *B65H 2701/31* (2013.01)

(58) Field of Classification Search

USPC ..... 242/474.3, 474.4, 474.5, 474.6, 474.7, 242/473.4, 473.5, 530, 533.4, 533.5, 533.6, 242/594, 594.1, 594.5, 594.6

See application file for complete search history.

(56) References Cited

U.S. PATENT DOCUMENTS

| | | | | |
|---|---|---|---|---|
| 2,946,526 | A * | 7/1960 | Kuroiwa et al. | 242/474.3 |
| 5,107,668 | A * | 4/1992 | Dammann | 57/278 |
| 5,284,010 | A | 2/1994 | Dammann | |
| 6,439,498 | B1 * | 8/2002 | Hufschmidt et al. | 242/471 |

FOREIGN PATENT DOCUMENTS

| | | |
|---|---|---|
| DE | 3425329 | 2/1985 |
| JP | 04-313564 | 11/1992 |
| JP | 05-193835 | 8/1993 |
| JP | 2008-500460 | 1/2008 |
| JP | 2008-63148 | 3/2008 |
| JP | 2009-208968 | 9/2009 |

OTHER PUBLICATIONS

Machine Translation of DE 3425329 A1, Feb. 14, 1985*

(Continued)

*Primary Examiner* — William E Dondero

(74) *Attorney, Agent, or Firm* — Jianq Chyun IP Office

(57) ABSTRACT

An automatic winding device for a filamentous material which is an automatic winding device for a filamentous material that winds a plurality of provided filamentous materials simultaneously onto a plurality of bobbins; and an automatic winding method utilizing the automatic winding device are provided. The automatic winding device includes a plurality of spindles for winding bobbins and a guide roll. The number of the plurality of spindles is 1-1.75 times the number of thread handling routes.

3 Claims, 4 Drawing Sheets

(56) References Cited

OTHER PUBLICATIONS

"International Search Report (Form PCT/ISA/210)", mailed on Jun. 5, 2012, with English translation thereof, p. 1-p. 3.

"1st Office Action of China Counterpart Application", with English translation thereof, issued on May 9, 2014, p. 1-p. 19.

"2nd Office Action of China Counterpart Application", with English translation thereof, issued on Sep. 29, 2014, p. 1-p. 20.

* cited by examiner

AUTOMATIC WINDING DEVICE FOR FILAMENTOUS MATERIAL AND AUTOMATIC WINDING METHOD

CROSS-REFERENCE TO RELATED APPLICATION

This application is a 371 application of an international PCT application serial no. PCT/JP2012/061095, filed on Apr. 25, 2012, which claims the priority benefit of Japan application no. 2011-102023, filed on Apr. 28, 2011. The entirety of each of the above-mentioned patent applications is hereby incorporated by reference herein and made a part of this specification.

FIELD OF THE INVENTION

The present invention relates to an automatic winding device for a filamentous material, which winds the filamentous material onto a bobbin, and an automatic winding method.

DESCRIPTION OF RELATED ART

Products of filamentous materials, such as hollow fiber membranes or filaments, are usually wound onto bobbins for storage and transportation.

A winding device provided with rotationally-driven bobbins (Japanese Patent Publication No. 2009-208968) is used when filamentous materials are wound. If there are several filamentous materials, the winding device may include multiple bobbins corresponding to the number of the filamentous materials.

Traditionally, when the winding amount of filamentous material on a bobbin reaches a predetermined amount, the operator would cut the filamentous material supplied to the bobbin and replace the bobbin with an empty bobbin. Since the supply of the filamentous material is continued during the replacement, the traditional winding method requires another operator, in addition to the operator who replaces the bobbins, to haul the continuously supplied filamentous material. Besides, because the filamentous material that is not wound onto the bobbin is wasted, the aforementioned method tends to increase the waste amount.

Therefore, Japanese Patent Publication No. 5-193835 proposes a winding device that can be used not only for winding filamentous materials but also for replacing bobbins. That is, the winding device of Japanese Patent Publication No. 5-193835 includes two bobbins installed to a turret board. When one bobbin at the winding position has taken up filamentous material of the predetermined amount, the turret board is rotated to move the other bobbin to the winding position, so as to switch the winding.

However, the winding device of Japanese Patent Publication No. 5-193835 does not have a simple structure.

SUMMARY OF THE INVENTION

Problem to be Solved

The present invention is to provide an automatic winding device and an automatic winding method for a filamentous material, which can reduce the number of operators and the waste amount of the filamentous material, despite its simplicity for use as a winding device.

Solution to the Problem

The present invention has the following embodiments.

[1] The automatic winding device for the filamentous material winds a plurality of supplied filamentous materials simultaneously onto a plurality of bobbins. The automatic winding device includes a plurality of spindles for installing the bobbins, and a plurality of guide rolls, wherein a number of the spindles is 1 to 1.75 times a number of thread handling routes.

[2] In the automatic winding device for the filamentous material of [1], a plurality of intervals disposed between the spindles is 1.2-3.0 times a diameter of the bobbins.

[3] In the automatic winding device for the filamentous material of [1] or [2], the spindles are respectively disposed at positions of vertexes of a regular polygon, a rhombus, or a rectangle.

[4] In the automatic winding device for the filamentous material of any of [1]-[3], the spindles are arranged linearly to form one or two rows or more; and among the spindles, at least the spindles in a same row are spaced by equal intervals.

[5] In the automatic winding device for the filamentous material of any of [1]-[4], a drive roll is further installed, for each of the thread handling routes, to adjust a winding speed.

[6] An automatic winding method for a filamentous material utilizes a winding device to continuously wind one or a plurality of filamentous materials that is supplied simultaneously onto the winding device. The automatic winding method includes: a step of installing to the winding device a plurality of bobbins, wherein the number of the bobbins is greater than the number of the filamentous materials supplied to the winding device; a step of winding and attaching an end of one of the filamentous materials that are supplied to the winding device to each of a part of the bobbins installed to the winding device; a step of continuously winding the filamentous materials by rotating the bobbins, to which the ends of the filamentous materials are wound and attached; and a step of switching to wind the filamentous materials onto the remaining bobbins, which are not wound with the filamentous materials, when a winding amount of the filamentous materials on the bobbins reaches a predetermined amount.

[7] According to the automatic winding method for the filamentous material of [6], the end of the filamentous material is disposed at a lateral side of the bobbin in the step of winding and attaching the end of the filamentous material.

[8] According to the automatic winding method for the filamentous material of [6] or [7], the bobbins are respectively installed to a plurality of spindles disposed in the winding device.

[9] The automatic winding method for the filamentous material of [8] further includes a step of removing the bobbin wound with a predetermined amount of winding from the spindle and installing a bobbin, which has no filamentous material wound thereon, to the spindle.

[10] According to the automatic winding method for the filamentous material of [8] or [9], the spindles constitute a spindle group, in which at least a set of spindles is arranged at predetermined intervals; and in the step of switching to wind the filamentous materials, the winding of the filamentous materials is switched between adjacent bobbins among the bobbins installed to the spindle group.

Effects of the Invention

The present invention provides the automatic winding device and the automatic winding method for filamentous materials, which can reduce the number of operators and the waste amount of filamentous materials, despite its simplicity for use as a winding device.

In the automatic winding device of the present invention, the number of the spindles is 1-1.75 times the number of the thread handling routes. Thus, the automatic winding device has a simple structure as a winding device and can improve working efficiency.

The interval between the spindles is set to be 1.2-3.0 times the used bobbin diameter. Thus, the working efficiency is raised.

The spindles are respectively disposed at positions of vertexes of a regular polygon, a rhombus, or a rectangle. Accordingly, the working efficiency can be increased.

Among the spindles, at least the spindles in the same row are spaced by equal intervals. Therefore, the winding positions can be easily switched.

According to the automatic winding method of the present invention, with the end of the filamentous material disposed at the lateral side of the bobbin in the step of winding and attaching the end, the end can be easily connected with an end of a filamentous material wound on another bobbin. Thus, the filamentous material can be easily prolonged, and when further processing the wound filamentous material, it is possible to improve the working efficiency at the time of unwinding the filamentous material from the bobbin.

In addition, if the bobbins are respectively installed to the spindles disposed in the winding device, the work becomes simpler and easier.

Furthermore, if the bobbin wound with the desired amount is removed and replaced by a bobbin that has no filamentous material wound thereon, the winding can be continued even in the situation that the length of the filamentous material exceeds a predetermined amount of the bobbin.

Moreover, if the spindles constitute a spindle group, in which at least a set of spindles is arranged at predetermined intervals, and the winding of the filamentous material is switched between adjacent bobbins among the bobbins installed to the spindle group, the working pattern is simplified and the work becomes simpler and easier.

DESCRIPTION OF THE EMBODIMENTS

The automatic winding method for the filamentous material in one aspect of the present invention includes the following steps.

(1) A step of installing to the aforementioned winding device a plurality of bobbins, which are more than the number of the filamentous materials to be supplied to the winding device.

(2) A step of winding and attaching an end of one of the filamentous materials supplied to the winding device to each of a part of the bobbins that are installed to the winding device.

(3) A step of continuously winding the filamentous materials by rotating the bobbins, to which the ends of the filamentous materials are attached.

(4) A step of switching to wind the filamentous materials onto the remaining bobbins, which are not wound with the filamentous materials, when a winding amount of the filamentous materials on the bobbins reaches a desired amount.

An embodiment of the automatic winding method for the filamentous material in the first aspect of the present invention (abbreviated as "winding method" hereinafter) is described below.

Figure 1:
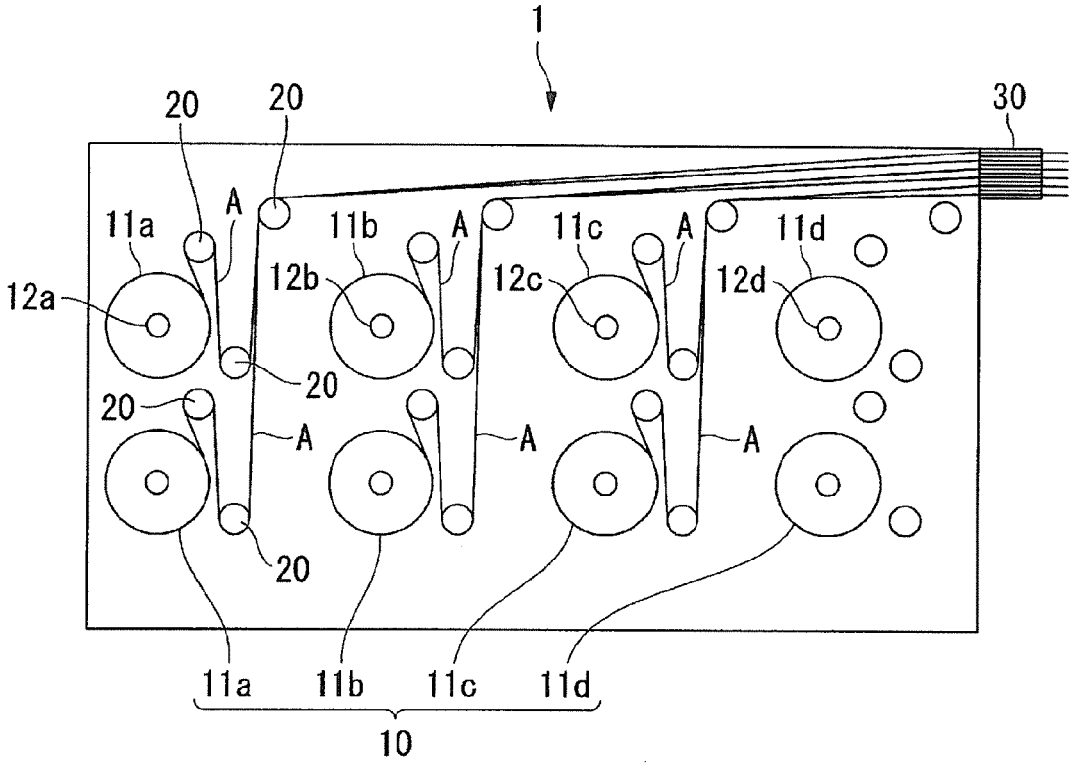
FIG. 1 is a schematic diagram illustrating an automatic winding device for use in an embodiment of a winding method for a filamentous material in a first aspect of the present invention, and illustrating an example of an automatic winding device for a filamentous material in a second aspect of the present invention.

FIG. 1 illustrates an automatic winding device for a filamentous material (may be abbreviated as "winding device" hereinafter), which utilizes the winding method of this embodiment. The winding device 1 of this embodiment is simultaneously supplied with six filamentous materials A, A . . . , each of which is wound onto one bobbin. The winding device 1 of this embodiment includes two rows of units 10, each including four bobbins 11*a*, 11*b*, 11*c*, 11*d* that are linearly arranged. That is, the winding device 1 of this embodiment includes eight bobbins in total, which is greater than the number of the filamentous materials. Herein, "thread handling routes" refer to the number of the filamentous materials (six, in the case of FIG. 1) that are actually supplied to the winding device at the same time. The number of the thread handling routes may be adjusted by members (e.g. multiple independently-driven drive rolls and route diverging devices of the filamentous materials) that are disposed for smoothly guiding and winding the filamentous materials, supplied from the drive rolls and the like right before the winding device, in a desired shape. In addition, the four bobbins 11*a*, 11*b*, 11*c*, 11*d* of each unit 10 are respectively installed to spindles (also called rotation shafts) 12*a*-12*d* that are driven to rotate independently. The spindles 12*a*-12*d* are arranged at a specific interval to constitute a spindle group, and in this embodiment, there are two spindle groups. Each spindle group corresponds to one unit of bobbins that are installed to the spindles thereof.

The filamentous materials A are continuously supplied to the bobbins 11*a*-11*d*, which are installed to the rotationally-driven spindles 12*a*-12*d*, via guide rolls 20, and thus multiple filamentous materials A can be wound at the same time.

According to the winding method that utilizes the automatic winding device, first, the bobbins 11*a*-11*d* are attached to the four spindles 12*a*-12*d* of each unit 10. One bobbin is attached to one spindle.

The number of the bobbins that are attached to the winding device is preferably 1-1.75 times the number of the filamentous materials, and more preferably 1.1-1.75 times. The working efficiency can be improved if the aforementioned condition is satisfied.

Figure 2:
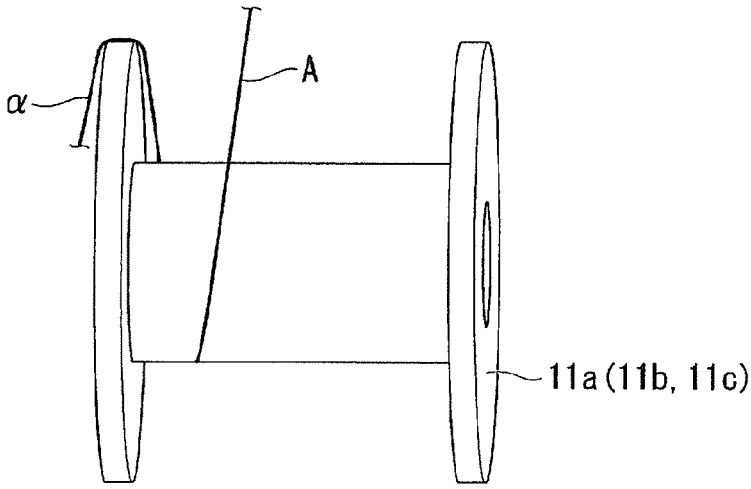
FIG. 2 is a perspective diagram illustrating an example of arrangement of a filamentous material before being wound onto a bobbin.

Next, the ends of the filamentous materials are wound and attached to the three bobbins 11*a*, 11*b*, 11*c* at a left side of each unit 10. That is, the number of the bobbins, to which the ends of the filamentous materials A are attached, is equal to the number of the filamentous materials A. In this case, as shown in FIG. 2, it is preferable to respectively dispose an end $\alpha$ of one of the filamentous materials A at a lateral side of each of the three bobbins 11*a*, 11*b*, 11*c* at the left side of each unit 10. By disposing the ends $\alpha$ of the filamentous materials A at the lateral sides of the bobbins 11*a*, 11*b*, 11*c* respectively, the ends α can be easily connected with the ends of filamentous materials wound on other bobbins, and the filamentous materials A can be easily prolonged.

A method for disposing the ends of the filamentous materials at the lateral sides of the bobbins is not particularly limited here.

Then, the spindles 12*a*, 12*b*, 12*c* are driven to rotate respectively and the bobbins 11*a*, 11*b*, 11*c* rotate to start winding, and the six filamentous materials A, A . . . that are continuously supplied via the guide rolls 20 are wound continuously using the bobbins 11*a*, 11*b*, 11*c*.

Here, the filamentous materials A supplied to the bobbins may be fibers such as filaments or yarn, hollow fiber membranes, ropes, wires, or strings such as braided strings or knitted strings, for example. Moreover, through a proper adjustment of a revolution of the spindles, the present invention can also be used on a filamentous material made of a soft resin, such as polyolefin or polyester, or a rigid filamentous material, such as optical fiber or reinforced fiber.

Figure 3:
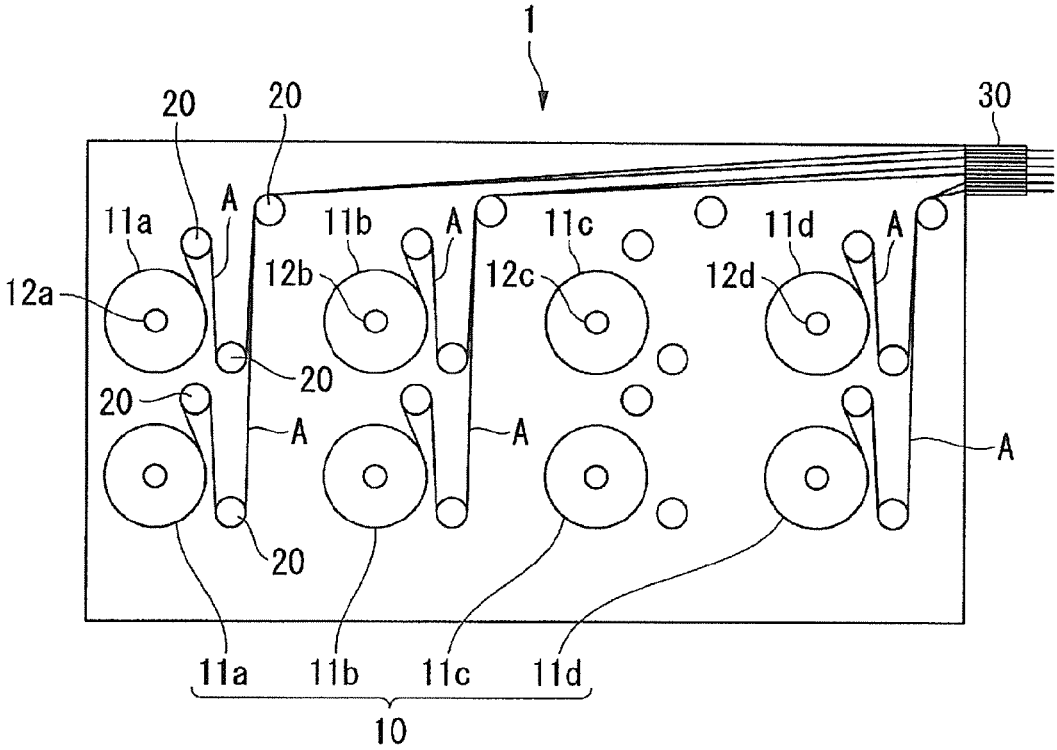
FIG. 3 is a diagram for explaining a winding switching step in an embodiment of the winding method for the filamentous material in the first aspect of the present invention.

Thereafter, when the winding amount on the bobbin 11*c* of each unit 10 reaches a desired amount, the filamentous material A supplied to the bobbin 11*c* is cut, as shown in FIG. 3, and the winding is switched to the bobbin 11*d*, which is adjacent to the bobbin 11*c* in the same unit 10 and has no filamentous material A wound thereon. The desired winding amount may be set according to the requirements.

The winding amount can be checked by any means, such as calculating a rotation speed and winding time of the bobbin (spindle) or measuring a variation of a total weight of the bobbin.

Then, after removing the bobbin 11*c* wound with the filamentous material A from the spindle 12*c* and attaching a bobbin with no filamentous material A wound thereon to the spindle 12*c* as the new bobbin 11*c*, the filamentous material A that is being supplied to the bobbin 11*b* is cut and the winding is switched to the new bobbin 11*c* adjacent to the bobbin 11*b*.

Following that, after removing the bobbin 11*b* wound with the filamentous material A from the spindle 12*b* and attaching a bobbin with no filamentous material A wound thereon to the spindle 12*b* as the new bobbin 11*b*, the filamentous material A that is being supplied to the bobbin 11*a* is cut and the winding is switched to the new bobbin 11*b* adjacent to the bobbin 11*a*. Moreover, the bobbin 11*a* wound with the filamentous material A is removed from the spindle 12*a* and a bobbin with no filamentous material A wound thereon is attached to the spindle 12*a* to serve as the new bobbin 11*a*.

The end α of the filamentous material A is preferably disposed at the lateral side of the bobbin 11*b*, 11*c*, 11*d* during the aforementioned switching.

After the aforementioned switching, the three bobbins 11*b*, 11*c*, 11*d* at a right side of each unit 10 are used to continuously wind the six filamentous materials A until the desired winding amount is obtained.

Then, when the bobbin 10*b* of each unit 10 has the desired winding amount, the filamentous material A that is being supplied to the bobbin 10*b* is cut and the winding is switched to the bobbin 11*a*, which is adjacent to the bobbin 11*b* in the same unit 10 and has no filamentous material A wound thereon.

Next, after removing the bobbin 11*b* wound with the filamentous material A from the spindle 12*b* and attaching a bobbin with no filamentous material A wound thereon to the spindle 12*b* as the new bobbin 11*b*, the filamentous material A that is being supplied to the bobbin 11*c* is cut and the winding is switched to the new bobbin 11*b* adjacent to the bobbin 11*c*.

Then, after removing the bobbin 11*c* wound with the filamentous material A from the spindle 12*c* and attaching a bobbin with no filamentous material A wound thereon to the spindle 12*c* as the new bobbin 11*c*, the filamentous material A that is being supplied to the bobbin 11*d* is cut and the winding is switched to the new bobbin 11*c* adjacent to the bobbin 11*d*. Moreover, the bobbin 11*d* wound with the filamentous material A is removed from the spindle 12*d* and a bobbin with no filamentous material A wound thereon is attached to the spindle 12*d* to serve as the new bobbin 11*d*.

By repeating the switching as described above, the six filamentous materials A, A . . . are continuously wound by the rotation of the three bobbins 11*a*, 11*b*, 11*c* at the left side of each unit 10.

When winding filamentous materials onto bobbins of the same number, the operator is required to cut the filamentous material supplied to the bobbin, remove the bobbin wound with the desired amount of filamentous material and replace it with an empty bobbin, and then switch the winding to the empty bobbin. For this reason, the working efficiency is low. By contrast thereto, the winding method of the aforementioned embodiment utilizes bobbins that are more than the filamentous materials. Thus, the winding can be rapidly switched to the adjacent bobbin that has no filamentous material wound thereon to continuously and efficiently wind the filamentous material. Consequently, a waste amount of the filamentous material can be reduced.

According to the winding method of the aforementioned embodiment, the aforementioned winding and switching are performed alternately. Thus, three filamentous materials A can be simultaneously and continuously wound onto three bobbins of each unit 10.

Furthermore, with the aforementioned winding method, the switching to a bobbin that has no filamentous material wound thereon can be rapidly done by one operator when the winding amount reaches the desired amount. Accordingly, the number of operators can be reduced, the amount of the filamentous material not wound onto the bobbin can be decreased, and the waste amount can be reduced.

Moreover, the winding device for use in the winding method does not include a bobbin switch device or the like and thus is simplified.

Besides, in the aforementioned embodiment, the bobbin wound with filamentous material of the desired amount is removed from the spindle and further a bobbin that has no filamentous material wound thereon is installed to the spindle. Thus, even if the length of the filamentous material exceeds a predetermined amount of the bobbin 11*a*-11*d*, the filamentous material A can be continuously wound.

In addition, because the winding of the filamentous material A is switched between adjacent bobbins of each unit 10, the working pattern is simplified and the work is simpler and easier.

The winding method in the first aspect of the present invention is not limited to the disclosure of the aforementioned embodiment.

For example, the winding of the filamentous material is switched within each unit according to the winding method of the aforementioned embodiment. However, the winding may also be switched between the units.

Moreover, the winding device of the aforementioned embodiment includes two rows of the units each having four linearly arranged bobbins for winding six filamentous materials. However, the winding device may be in other forms if the number of the bobbins is greater than the number of the filamentous materials.

For example, the number of the rows of the units each having four linearly arranged bobbins may be one or three or more.

In addition, the number of the bobbins included in each row of the units is not necessarily four and may be varied corresponding to the number of the filamentous materials.

Figure 5:
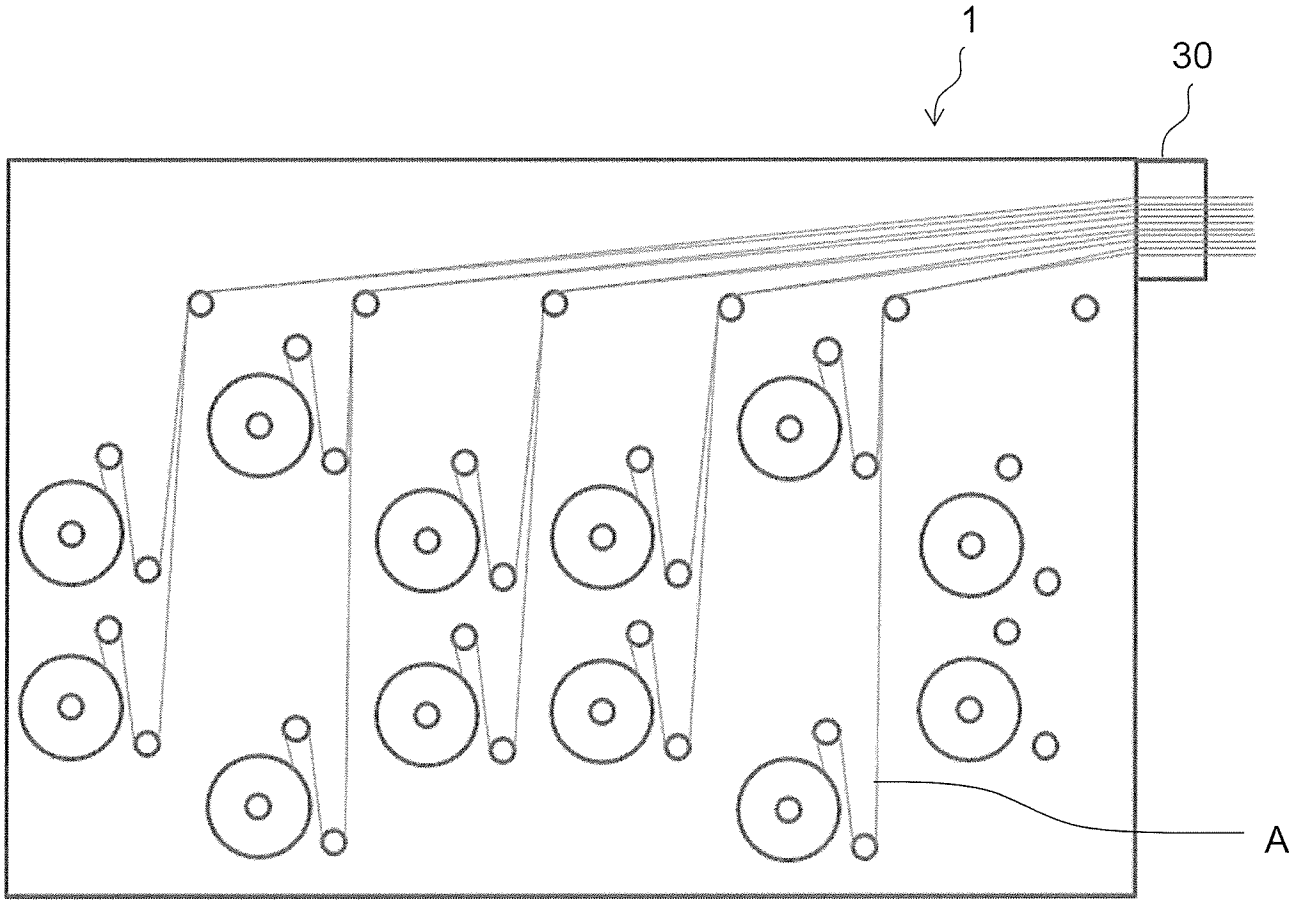
FIG. 5 is a schematic diagram illustrating an embodiment of the automatic winding device for the filamentous material in which the multiple bobbins are arranged in at least one regular polygon.
Figure 6:
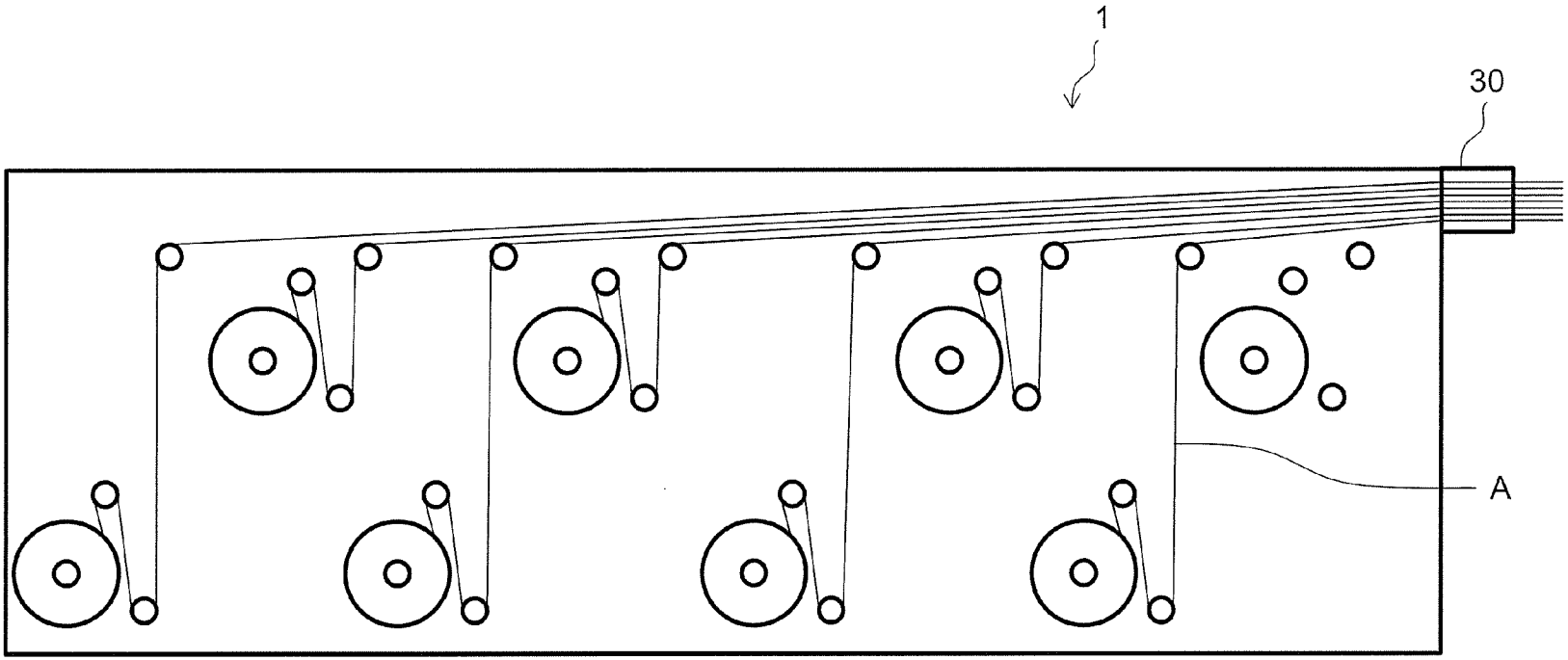
FIG. 6 is a schematic diagram illustrating an embodiment of the automatic winding device for the filamentous material in which the multiple bobbins are arranged in at least one rhombus.

Moreover, in the aforementioned embodiment, the multiple bobbins are respectively arranged at positions of vertexes of a rectangle. However, the multiple bobbins may also be arranged in a circle or be arranged at positions of vertexes of a regular polygon or a rhombus. Referring to FIG. 5 and FIG. 6, wherein in FIG. 5 the bobbins respectively arranged in two regular polygons, and in FIG. 6 the bobbins respectively arranged in two rhombuses are exemplarily illustrated.

An embodiment of an automatic winding device for a filamentous material in the second aspect of the present invention (may be abbreviated as "winding device" hereinafter) is described below.

The winding device in the second aspect of the present invention is an automatic winding device that winds a plurality of provided filamentous materials onto a plurality of bobbins simultaneously. The automatic winding device includes a plurality of spindles for installing the bobbins, a plurality of thread handling routes, and a plurality of guide rolls. The number of the spindles is 1-1.75 times the number of the thread handling routes.

FIG. 1 illustrates an example of the automatic winding device for the filamentous material in the second aspect of the present invention. The winding device of FIG. 1 includes a plurality of spindles 12*a*, 12*b*, 12*c*, 12*d*, a plurality of thread handling routes 30, and guide rolls 20.

Here, the number of the spindles is eight and the number of the thread handling routes is six. Accordingly, the number of the spindles is 1.33 times the number of the thread handling routes, which falls in the range of 1-1.75 times.

The members in FIG. 1 perform the same functions as described in the aforementioned winding method.

The number of the spindles is preferably 1.01-1.75 times the number of the thread handling routes, and more preferably 1.05-1.7 times.

If the number of the spindles is equal to or less than the number of the thread handling routes, workability is lowered since the bobbin replacement become two-operator process. On the other hand, if the number of the spindles exceeds 1.75 times the number of the thread handling routes, investment in the equipment is raised which results in an increase in costs.

In addition, if the number of the spindles is 1.5 times the number of the thread handling routes or less, it is possible to eliminate the intervals between the spindles, and thus the device becomes compact, which is more preferable.

The interval between the multiple spindles may be 1.2-3.0 times a bobbin diameter that is used. To be more specific, the interval of the linearly arranged spindle group is preferably 1.2-3.0 times the used bobbin diameter, and more preferably 1.5-2.5 times. By setting the interval between the spindles equal to or less than an upper limit, utilization of equipment installation space can be more efficient. By setting the interval equal to or greater than a lower limit, adequate working space can be maintained.

The bobbin diameter refers to a diameter (flange diameter) of the bobbin that is used.

The multiple spindles are respectively disposed at the positions of the vertexes of the regular polygon, rhombus, or rectangle. Such a configuration can improve the working efficiency. Among the aforementioned shapes, square is preferred. More specifically, the regular polygon may be a regular triangle, a square, a regular pentagon, a regular hexagon, a regular octagon, etc., for example. In FIG. 1, the spindles 12*a* and 12*b* and the two spindles arranged thereunder form a rectangle.

The multiple spindles are arranged linearly to form one or two rows or more. Among the aforementioned spindles, at least the spindles in the same row are spaced by equal intervals. By spacing the spindles at equal intervals, the winding positions can be easily switched.

Furthermore, FIG. 1 illustrates that three guide rolls are disposed for each spindle. However, the present invention is not particularly limited thereto. Preferably 1-10 guide rolls are disposed for each spindle, and more preferably 1-5 guide rolls. Accordingly, the equipment can be made compact.

In addition, an interval between the guide rolls is preferably 1.2-3.0 times the bobbin diameter, and more preferably 1.5-2.5 times. Accordingly, the working space can be maintained.

Figure 4:
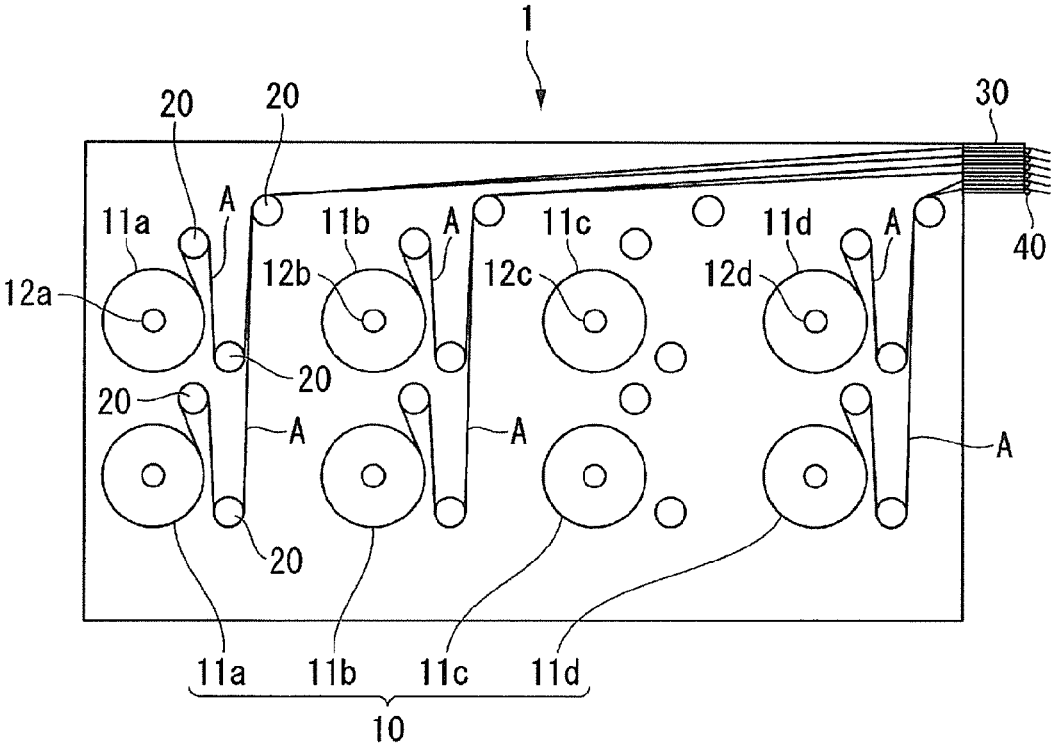
FIG. 4 is a schematic diagram illustrating an embodiment of the automatic winding device for the filamentous material in the second aspect of the present invention, and illustrating an example of an automatic winding device provided with drive rolls.

FIG. 4 is a diagram illustrating an example of a winding device with a drive roll 40. As shown in FIG. 4, the winding device in the second aspect of the present invention can further include drive rolls 40 for the respective thread handling routes 30 for adjusting a winding speed. With use of the drive rolls, the winding speed of the filamentous materials can be adjusted, and the waste amount of filamentous materials, resulting from the drop in the winding speed during the switching, can be reduced. Positions of the drive rolls are not particularly limited.

The number of the spindles is in a range of 1-1.75 times the number of the drive rolls, preferably 1.01-1.75 times, and more preferably 1.05-1.7 times. In FIG. 4, eight spindles are disposed corresponding to six drive rolls.

When winding filamentous materials using spindles whose number is the same as that of the thread handling routes, the operator is required to cut the filamentous material supplied to the bobbin, remove the bobbin wound with the desired amount of filamentous material and replace it with an empty bobbin, and then switch the winding to the empty bobbin. For this reason, the working efficiency is low. By contrast thereto, the winding device of the aforementioned embodiment utilizes spindles that are more than the thread handling routes. Thus, the winding can be rapidly switched to the adjacent bobbin that has no filamentous material wound thereon to continuously and efficiently wind the filamentous material. Consequently, the waste amount of the filamentous material can be reduced.

In the winding device of the aforementioned embodiment, the aforementioned winding and switching are performed alternately. Thus, three filamentous materials A can be simultaneously and continuously wound onto three bobbins of each unit 10.

Furthermore, with the aforementioned winding device, the switching to a bobbin that has no filamentous material wound thereon can be rapidly done by one operator when the winding amount reaches the desired amount. Accordingly, the number of operators can be reduced, the amount of the filamentous material not wound onto the bobbin can be decreased, and the waste amount can be reduced.

Moreover, the winding device does not include a bobbin switch device or the like and thus is simplified.

Besides, in the aforementioned embodiment, the bobbin wound with filamentous material of the desired amount is removed from the spindle and further a bobbin that has no filamentous material wound thereon is installed to the spindle. Therefore, even if the length of the filamentous material exceeds a predetermined amount of the bobbin 11*a*-11*d*, the filamentous material A can be continuously wound.

In addition, because the winding of the filamentous material A is switched between adjacent bobbins of each spindle group, the working pattern is simplified and the work is simpler and easier.

The winding device in the second aspect of the present invention is not limited to the aforementioned embodiment.

In the aforementioned embodiment, the winding device includes two rows of units each having four linearly arranged bobbins for winding six filamentous materials. However, the winding device may also be in other form if the number of the spindles is 1 to 1.75 times the number of the thread handling routes, and more preferably 1.1-1.5 times considering working efficiency.

For example, the number of the rows of the spindle groups each including four linearly arranged spindles may be one or three or more.

In addition, the number of the spindles in each row of spindle group is not necessarily four, which may be varied according to the number of the thread handling routes.

Furthermore, the number of the spindles and the number of the thread handling routes may be varied. The winding device may be configured in any way in order that the number of the spindles is 1-1.75 times, or more preferably 1.1-1.5 times, the number of the thread handling routes.

INDUSTRIAL APPLICABILITY

The present invention provides the automatic winding device and the automatic winding method that can reduce the number of operators and the waste amount of filamentous materials despite its simplicity for use as a winding device.

What is claimed is:

1. An automatic winding device for a filamentous material, which simultaneously winds a plurality of supplied filamentous materials onto a plurality of bobbins, the automatic winding device comprising:

a plurality of spindles for installing the bobbins; and a plurality of guide rolls, wherein each of the plurality of supplied filamentous materials is guided over at least one of the plurality of guide rolls to a respective one of the plurality of spindles, and a plurality of drive rolls, wherein each of the plurality of drive rolls is independently driven, supplies each of the filamentous material simultaneously and adjusts a winding speed of each of the filamentous materials individually, wherein a number of the plurality of spindles is more than 1 and less than 1.75 times the number of the plurality of supplied filamentous materials, and each of the plurality of spindles is respectively disposed at each of positions of vertexes of at least one regular polygon or at least one rhombus.

2. The automatic winding device according to claim 1, wherein a plurality of intervals disposed between the spindles is 1.2-3.0 times a diameter of the bobbins.

3. The automatic winding device according to claim 1, wherein the plurality of spindles is arranged linearly to form one or two rows or more; and among the plurality of spindles, at least the spindles in a same row are spaced by equal intervals.

* * * * *